US005680087A

United States Patent [19]

Sakata et al.

[11] Patent Number: 5,680,087

[45] Date of Patent: Oct. 21, 1997

[54] WIND TYPE COIL

[75] Inventors: Keiji Sakata; Tetsuya Morinaga, both of Nagaokakyo, Japan

[73] Assignee: Murata Manufacturing Co., Ltd., Japan

[21] Appl. No.: 462,629

[22] Filed: Jun. 5, 1995

Related U.S. Application Data

[62] Division of Ser. No. 240,834, May 11, 1994, Pat. No. 5,457,872.

[30] Foreign Application Priority Data

May 11, 1993 [JP] Japan ..... 5-108962

[51] Int. Cl.[6] ..... H01F 15/10; H01F 27/30

[52] U.S. Cl. ..... 336/83; 336/96; 336/192; 336/208

[58] Field of Search ..... 336/83, 192, 96, 336/205, 198, 208

[56] References Cited

U.S. PATENT DOCUMENTS

| | | | |
|---|---|---|---|
| 3,510,624 | 5/1970 | Bennett | 336/192 |
| 3,824,518 | 7/1974 | Slenker | 336/192 |
| 4,064,472 | 12/1977 | Gunewardena et al. | 336/192 |
| 4,769,900 | 9/1988 | Morinaga et al. | 336/83 |
| 4,777,461 | 10/1988 | Sakamoto | 336/192 |

FOREIGN PATENT DOCUMENTS

| | | | |
|---|---|---|---|
| 62-47101 | 8/1985 | Japan | 336/192 |
| 3-163808 | 11/1989 | Japan | 336/192 |
| 3-161912 | 7/1991 | Japan | 336/192 |

*Primary Examiner*—Thomas J. Kozma

*Attorney, Agent, or Firm*—Ostrolenk, Faber, Gerb & Soffen, LLP

[57] ABSTRACT

A wind type coil has a core with a flange whose bottom surface has a recess, and an electrode is formed on the bottom surface of the flange and is extended to the recess. A wire is wound around a body of the core, and an end of the wire is welded to the electrode in the recess by thermocompression bonding or resistance welding. The wind type coil is armored by a resin armor, part of the electrode on the bottom surface of the flange being kept bare.

9 Claims, 1 Drawing Sheet

WIND TYPE COIL

This is a division of application Ser. No. 08/240,834, filed May 11, 1994, now U.S. Pat. No. 5,457,872.

BACKGROUND OF THE INVENTION

1. Field of the Invention

The present invention relates to a wind type coil, and more particularly to a wind type coil which is used as an inductance element in a filter circuit, an oscillation circuit or the like.

2. Description of Related Art

Generally, a wire used for a wind type coil is a copper wire with an insulating coat such as polyurethane. Conventionally, just before and after the wire is wound around a body of a core, the insulating coat of the wire is removed at the winding start portion and the winding end portion, and the bare portions of the wire are soldered to electrodes formed on the score.

Soldering requires an after process of flux cleaning, and a cleaner used for the flux cleaning contains a substance which destroys the ozone layer. Thus, soldering is a problem from the viewpoint of environmental protection. Further, there are technological problems in soldering as follows: flux is likely to remain even after the flux cleaning, and the residual flux may damage the insulating coat of the wire; and since copper diffuses into solder easily, the copper wire partly diffuses into solder during the soldering process and becomes thin, which may cause breaking of the wire.

SUMMARY OF THE INVENTION

An object of the present invention is to provide a wind type coil which has a reliable connection between a wire and an electrode and can be produced without a soldering process.

In order to attain the object, a wind type coil according to the present invention comprises a core which has a flange whose bottom surface has a recess, and an electrode which is formed on the bottom surface of the flange and extended to the recess. A wire is wound around a body of the core, and the end of the wire is welded to the electrode in the recess by thermocompression bonding or resistance welding. The weld portion between the end of the wire and the electrode is covered by ,a resin armor.

According to the present invention, the end of the wire is welded to the electrode by thermocompression bonding or resistance welding, not by soldering which has the problems described above. Thus, damage to the insulating coat of the wire and thinning of the copper wire will not occur. Further, the weld portion between the end of the wire and the electrode is covered by the resin armor and protected from external force. Thus, the reliability of connection between the wire and the electrode is improved.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An exemplary wind type coil according to the present invention is described with reference to the accompanying drawings.

Figure 1:
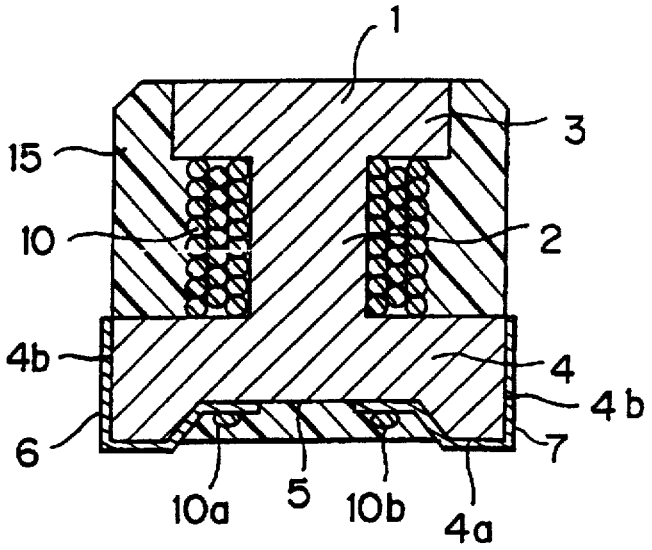
FIG. 1 is a sectional view of a wind type coil according to the present invention.
Figure 2:
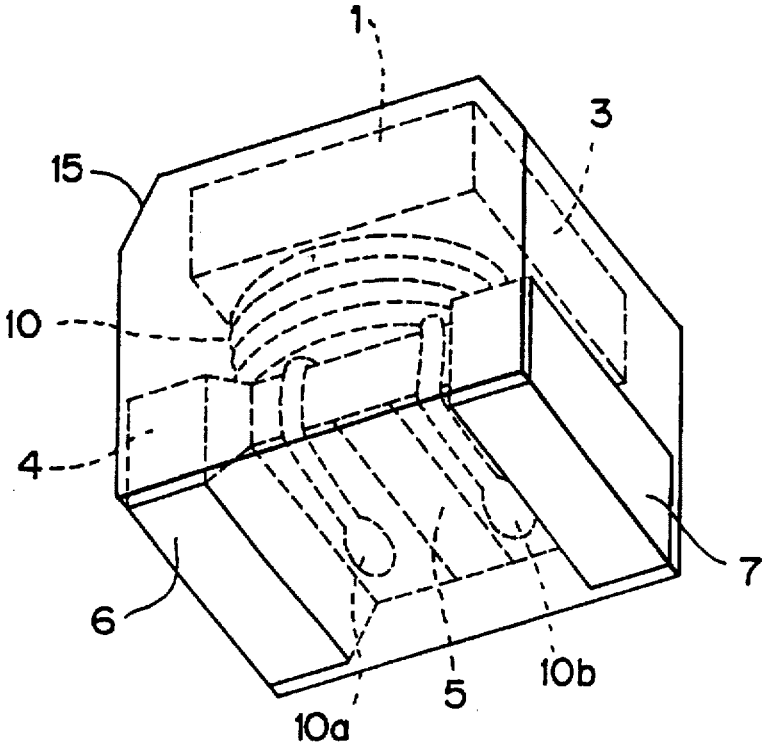
FIG. 2 is a perspective view of the wind type coil.

The wind type coil shown by FIGS. 1 and 2 is a surface mounting type. The wind type coil comprises a core 1, a wire 10 and a resin armor 15. The core 1 has flanges 8 and 4 at both ends of a body 2. On the bottom surface 4*a* of the lower flange 4, a recess 5 is made to fit both ends 10*a* and 10*b* of the wire 10 therein. Referring to FIG. 1, the recess 5 is like a groove running from the front side through the rear side. The recess 5 has a depth which is larger than the diameter of the ends 10*a* and 10*b* of the wire 10. Thereby, with the wire ends 10*a* and 10*b* fitted in the recess 5, the wind type coil can keep a flat lower surface to engage the surface that the coil is to be mounted on.

At both sides of the lower flange 4, electrodes 6 and 7 are provided. The electrodes 6 and 7 are extended from the respective sides to the bottom surface 4*a* and further to the recess 5.

The wire 10 is wound around the body 2 of the core 1, and both ends 10*a* and 10*b* are welded to the electrodes 6 and 7 respectively in the recess 5 by thermocompression bonding or resistance welding. Thereby, the wire 10 is electrically connected with the electrodes 6 and 7. The processes of thermal compression bonding and resistance welding will be described later.

The core 1 is made of a dielectric material such as ceramics, an insulating material or a magnetic material such as ferrite. The electrodes 6 and 7 are made of silver, a mixture of silver and palladium, or the like. The wire 10 is a copper wire with a polyurethane insulating coat.

The resin armor 15 is made by molding or the like, keeping the upper surface of the upper flange 3 and part of the electrodes 6 and 7 on the bottom of the lower flange 4 bare. The weld portions between the wire end 10*a* and the electrode 6 and between the wire end 10*b* and the electrode 7 are covered and protected by the resin armor 15. Thereby, the weld portions are protected from any external force, and it is unlikely that the ends 10*a* and 10*b* will come apart from the electrodes 6 and 7. When the wind type coil is mounted on a printed circuit board, the bare portions of the electrodes 6 and 7 serve as outside electrodes, and metal plate terminals are not necessary. Since the electrodes 6 and 7, which serve as outside electrodes, are provided at both sides of the wind type coil, the distance between the electrodes 6 and 7 is large enough that on a printed circuit board on which the wind type coil is to be mounted, a signal line can be provided between lands for the electrodes 6 and 7. Thus, high-density wiring on the printed circuit board becomes possible.

The armor 15 is preferably made of a thermoplastic resin or a thermosetting resin which is heat resisting and insulating.

Next, the processes of thermocompression bonding and resistance welding of the wire ends 10*a* and 10*b* with the electrodes 6 and 7 will be described.

First, thermocompression bonding is described.

The end 10*a* of the wire 10 is placed on the electrode 6, and a heater chip, which is a device for thermocompression bonding, is pressed on the wire end 10*a*. The insulating coat on the wire end 10*a* is melted by heat, and the copper wire shows. Further, by the heat of the heater chip, the copper wire is softened while being kept in contact with the electrode 6. In this way, the wire end 10*a* and the electrode 6 are welded. The other wire end 10*b* and the electrode 7 are welded in the same manner.

Next, resistance welding is described.

The insulating coat is removed from the wire at the end 10*a*, and the copper wire shows at that portion. Then, the wire end 10*a* is placed on the electrode 6. An electrode chip, which is a welding device, is pressed on the wire end 10*a*, and a large current flows from the electrode chip to the electrode 6 through the copper wire for a short time. The resistance in the contact portion between the copper wire and the electrode 6 causes generation of heat, and the copper wire is softened by the heat. Thus, the wire end 10*a* and the electrode 6 are welded. The other wire end 10*b* and the electrode 7 are welded in the same manner.

Although the wind type coil in this embodiment is a surface mounting type, the present invention is also applicable to a wind type coil of an insert mounting type.

In order to inhibit leakage of magnetic flux, magnetic powder shall be contained in the material of the armor 15.

Although the present invention has been described in connection with the preferred embodiment above, it is to be noted that various changes and modifications are possible to those who are skilled in the art. Such changes and modifications are to be understood as being within the scope of the invention.

What is claimed is:

1. A coil comprising:

a core which has a body and a flange disposed at an end of the body, the flange having two opposing sides and a bottom surface, the bottom surface of the flange having projections extending therefrom and forming a recess on the bottom surface between the projections;

electrodes which are disposed on each of the two sides of the flange and extended into the recess, each of the electrodes having portions on the sides of the flange and on the projections, respectively, the electrodes being placed out of contact with each other in the recess;

a wire having two ends wound around the body of the core, one of the ends of the wire being welded to each of the electrodes, respectively, in the recess; and a resin armor which covers at least the weld portions between the ends of the wire and the electrodes, leaving bare the portions of the electrodes which are on the sides of the flange and on the projections.

2. A coil as claimed in claim 1, wherein the ends of the wire are welded to the electrodes by thermocompression bonding.

3. A coil as claimed in claim 1, wherein the ends of the wire are welded to the electrodes by resistance welding.

4. A coil as claimed in claim 1, wherein the coil is completely covered by the resin armor except the portions of the electrodes on the sides of the flange and on the projections.

5. A coil as claimed in claim 1, wherein the core is made of a dielectric material.

6. A coil as claimed in claim 1, wherein the core is made of an insulating material.

7. A coil as claimed in claim 1, wherein the core is made of a magnetic material.

8. A coil as claimed in claim 1, wherein the resin armor contains a magnetic material.

9. A coil as claimed in claim 4, wherein the resin armor contains a magnetic material.

* * * * *